US006630886B2

(12) United States Patent
Malone, Jr.

(10) Patent No.: US 6,630,886 B2
(45) Date of Patent: Oct. 7, 2003

(54) TOP OF ELEVATOR CAR INSPECTION STATION WITH ALARM

(75) Inventor: Thomas F. Malone, Jr., Avon, CT (US)

(73) Assignee: Otis Elevator Company, Farmington, CT (US)

( * ) Notice: Subject to any disclaimer, the term of this patent is extended or adjusted under 35 U.S.C. 154(b) by 168 days.

(21) Appl. No.: 09/901,803

(22) Filed: Jul. 10, 2001

(65) Prior Publication Data

US 2003/0010576 A1 Jan. 16, 2003

(51) Int. Cl.[7] ..... G08B 21/00

(52) U.S. Cl. ..... 340/540; 187/390; 187/391

(58) Field of Search ..... 340/540, 522, 340/521; 187/390, 391

(56) References Cited

U.S. PATENT DOCUMENTS

| | | | | | |
|---|---|---|---|---|---|
| 4,004,655 | A | * | 1/1977 | Kraft et al. | 187/324 |
| 5,443,142 | A | * | 8/1995 | Glaser | 187/316 |
| 5,644,111 | A | * | 7/1997 | Cerny et al. | 187/393 |
| 5,721,403 | A | | 2/1998 | Hoppie et al. | 187/391 |
| 5,749,443 | A | * | 5/1998 | Romao | 187/384 |
| 5,773,771 | A | | 6/1998 | Chatham | 187/282 |
| 6,202,797 | B1 | * | 3/2001 | Skolnick et al. | 187/317 |
| 6,223,861 | B1 | | 5/2001 | Sansevero | 187/316 |

FOREIGN PATENT DOCUMENTS

| | | |
|---|---|---|
| JP | 11-301940 | 11/1999 |

* cited by examiner

*Primary Examiner*—Thomas Mullen

(57) ABSTRACT

An improved top of car inspection station includes warning circuit for providing a warning signal whenever the elevator car is in the inspection mode and the emergency stop switch is deactivated and the mechanic is not commanding the car to move.

8 Claims, 1 Drawing Sheet

TOP OF ELEVATOR CAR INSPECTION STATION WITH ALARM

TECHNICAL FIELD

This invention relates to improving mechanic safety while performing elevator maintenance.

BACKGROUND ART

Elevator mechanics are typically required to perform periodic maintenance that requires they be on top of the car. The mechanic is further required to operate the car from this position through a top of car inspection station 10, the front panel 12 of which is shown in FIG. 1. Elevators typically operate at speeds in the range of 0.5 to 9 m/s. These speeds would make it difficult for the mechanic to perform inspections or to position the car for maintenance. Therefore a slower inspection speed is provided in accordance with the governing safety regulations. In addition to operating the car at inspection speed the top of car inspection station provides the mechanic with sole control over car motion and makes the car unavailable to respond to calls.

The mechanic must access the top of the car by following prescribed safety procedures, which require the mechanic to press the stop switch 16 prior to stepping on top of the car. Once on top of the car the mechanic is required to place the car in the inspection mode by placing the inspection switch 14 in the inspection position 28.

To move the car the mechanic must first deactivate the stop switch 16, activate the common switch 18 then simultaneously activate either the car-up 20 or car-down switch 22 depending on the desired direction of travel.

The common switch 18 is provided to ensure that inadvertent activation of either the car-up or car-down switch alone does not cause unintended car motion. The stop switch 16 is provided to prevent any movement of the car not directed by the mechanic and is required to be activated whenever the car is not being moved.

However, the current practice requires the mechanic to remember to activate the stop switch 16. There is no signal or warning should the mechanic fail to activate the stop switch 16, which could lead to unanticipated movement of the elevator car, in the event of failure of the inspection mode circuit.

DISCLOSURE OF INVENTION

Objects of the invention include provision of an improved top of car inspection station that provides a signal indicating the stop switch is not activated whenever the car is in the inspection mode and is not being moved by the mechanic.

According to the present invention, the top of the car inspection station includes a warning circuit that includes an alarm that is activated whenever the mechanic fails to activate the stop button when not moving the car during inspection mode.

BEST MODE FOR CARRYING OUT THE INVENTION

Figure 1:
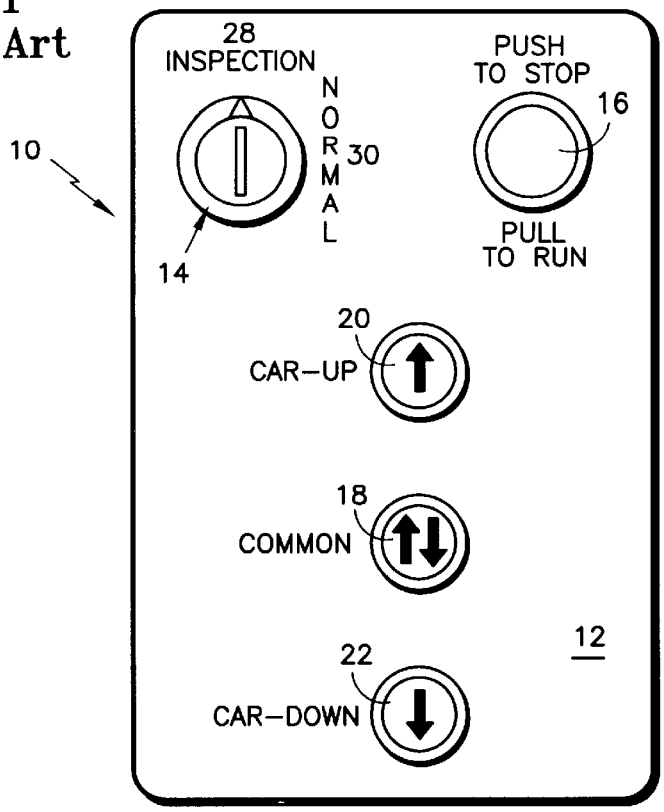
FIG.1 Prior Art
FIG. 1 is a plan view of the front panel of a prior art top of car inspection station.
Figure 2:
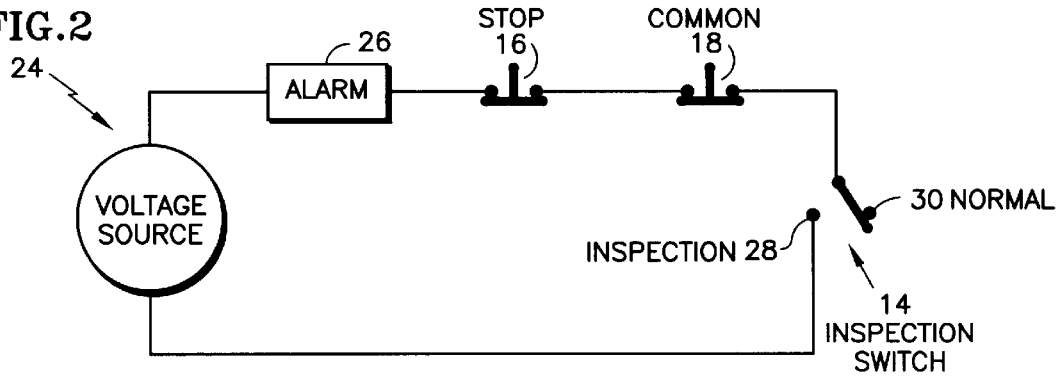
FIG. 2 is a schematic of a first embodiment of the subject invention.

According to the present invention, the top of car inspection station 10 includes a warning circuit 24 shown in FIG. 2. This warning circuit 24 includes an alarm 26 that is wired in series with the inspection 14, common 18 and stop 16 switches. The inspection switch 14 is a two-position switch that must be either in the inspection position 28 or normal position 30. The common 18 and stop 16 switches are also two-position switches that close the circuit when deactivated.

Therefore if the inspection switch 14 is activated (inspection position 28) and the stop switch 16 is activated (open) or the common switch 18 is activated (open) the alarm will not be acitvated. However if the common switch 18 is deactivated (closed), indicating the car is not moving, and the mechanic forgets to activate (open) the stop switch 16, the alarm will be activated, alerting the mechanic to activate the stop switch 16, which prevents the car from moving. The alarm 26 may be an audible alarm such as a horn, visual alarm such as light, or a combination of the two.

Figure 3:
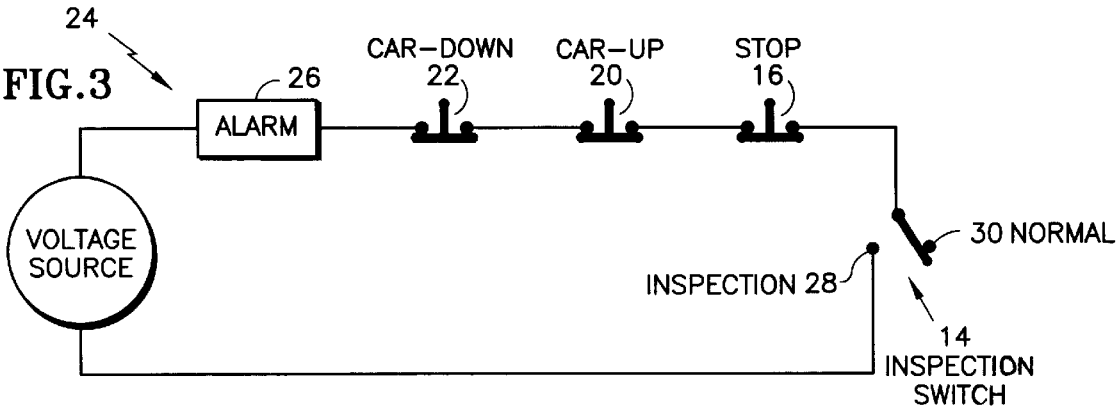
FIG. 3 is a schematic of a second embodiment of the subject invention.

A second embodiment of the invention is shown in FIG. 3 for a top of car inspection station not having a common switch 18. The car-up switch 20 and car-down switch 22 are connected in series in place of the common switch 18. Activation of either switch 20, 22 will prevent activation of the alarm 26. If neither switch 20, 22 is activated and the stop switch 16 is deactivated the alarm 26 will be activated.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

I claim:

1. A top of car inspection station having a selector switch for placing an elevator in inspection mode when activated, a stop switch for preventing movement of the elevator car when activated, a car-up switch for moving the car in an upwardly direction, a car-down switch for moving the car in a downwardly direction, and a common switch, wherein the car will move upwardly at inspection speed upon activation of the selector switch, the common switch, and the car-up switch and deactivation of the stop switch, wherein the car will move downwardly upon activation of the selector switch, the common switch, and the car-down switch and deactivation of the stop switch, the top of car inspection station comprising:

a warning device for providing a warning signal when said inspection switch is activated and said stop switch and said common switch are deactivated.

2. The top of car inspection station of claim 1 wherein said warning signal is an audible tone.

3. The top of car inspection station of claim 1 wherein said warning signal is a light signal.

4. The top of car inspection station of claim 1 wherein said warning signal comprises an audible tone and a light signal.

5. A top of car inspection station having a selector switch for placing an elevator in inspection mode when activated, a stop switch for preventing movement of the elevator when activated, a car-up switch for moving the car in an upwardly direction, and a car-down switch for moving the car in a downwardly direction, wherein the car will move upwardly at inspection speed upon activation of the selector switch, and the car-up switch and deactivation of the stop switch, wherein the car will move downwardly upon activation of the selector switch, and the car-down switch and deactivation of the stop switch, the top of car inspection station comprising:

a warning device for providing a warning signal when said inspection switch is activated and said stop switch, said car-up and said car-down switches are deactivated.

6. The top of car inspection station of claim 5 wherein said warning signal is an audible tone.

7. The top of car inspection station of claim 5 wherein said warning signal is a light signal.

8. The top of car inspection station of claim 5 wherein said warning signal comprises an audible tone and a light signal.

* * * * *